US006623184B1

(12) United States Patent
O'Keefe et al.

(10) Patent No.: US 6,623,184 B1
(45) Date of Patent: Sep. 23, 2003

(54) LOW COST, UPGRADEABLE, DEEP-TANK AUTOMATED X-RAY FILM PROCESSOR

(75) Inventors: Philip J. O'Keefe, Kane County, IL (US); James J. Flanigan, Kane County, IL (US)

(73) Assignee: Fischer Industries, Inc., Geneva, IL (US)

( * ) Notice: Subject to any disclaimer, the term of this patent is extended or adjusted under 35 U.S.C. 154(b) by 0 days.

(21) Appl. No.: 10/093,293

(22) Filed: Mar. 7, 2002

(51) Int. Cl.[7] ..... G03D 3/08
(52) U.S. Cl. ..... 396/612; 396/616; 396/622
(58) Field of Search ..... 396/602, 594, 396/603, 612, 622, 624, 636, 616; 355/27–29, 40, 41; 134/64 P, 64 R, 122 P

(56) References Cited

U.S. PATENT DOCUMENTS 3,264,970 A * 8/1966 Hersh et al. ..... 396/620
3,462,221 A * 8/1969 Tajima et al. ..... 355/27
3,495,520 A * 2/1970 Schumacher ..... 396/620
3,620,725 A * 11/1971 Kosta ..... 396/622
4,650,308 A 3/1987 Burbury
5,127,465 A 7/1992 Fischer
5,182,593 A 1/1993 Fischer
5,185,624 A 2/1993 Fischer
5,255,042 A 10/1993 Fischer et al.
5,262,817 A 11/1993 Krystal
5,369,459 A 11/1994 Muchisky et al.
5,446,516 A 8/1995 Burbury et al.
5,953,551 A * 9/1999 Tanaka ..... 396/636

* cited by examiner

*Primary Examiner*—D. Rutledge
(74) *Attorney, Agent, or Firm*—Polster, Lieder, Woodruff & Lucchesi

(57) ABSTRACT

A low cost, automated film processing system which can replace existing hand dipping development of films, but which is also later expandable in field, to accommodate additional features, should an upgrade to those features be desired. In the preferred embodiment, the design utilizes deep tanks, as defined in the specification, to enable the chemicals to be utilized over an extended period of time. The chemistry utilized in the processor operates at room temperature.

10 Claims, 5 Drawing Sheets

LOW COST, UPGRADEABLE, DEEP-TANK AUTOMATED X-RAY FILM PROCESSOR

CROSS REFERENCE TO RELATED APPLICATIONS

NONE

STATEMENT REGARDING FEDERALLY SPONSORED RESEARCH OR DEVELOPMENT

Not applicable

BACKGROUND OF THE INVENTION

This invention relates generally to film processing, and more particularly, to a low-cost system for developing x-ray films on a semi automated basis. While the invention is described in particular reference to its use for x-ray film development, those skilled in the art will recognize the wider applicability from the principals disclosed hereinafter.

Table-top automatic x-ray film processors often are used in individual offices of dentists, doctors and chiropractors, for example, to develop films taken of patients under treatment. Conversely, floor-standing automatic x-ray film processors are normally used in hospitals, where higher-volume film processing is required. In general, a body of art has developed around automatic film processors that utilize heated liquid chemicals in order to develop the film. As used herein, heated liquid chemicals refer to developer solutions, for example, which are specifically formulated for use in automatic x-ray film processors and which are normally utilized within a temperature range of 89 to 96 degrees Fahrenheit. These automatic x-ray film processors require heaters for the developer chemistry and often include automatic replenishment systems, recirculation systems and process control systems to bring developer chemistry to operating temperature, and maintain temperatures at specific levels, within a narrow range, over long time periods. Because the developer chemistry must be heated to a relatively high temperature, there is a considerable warm-up period required before the processor may be utilized to develop films.

Existing tabletop automatic film processors generally require 15 amp electrical service (10 amps at minimum) to operate their heaters and associated equipment, and generally require permanent plumbing connections for proper operation. Existing tabletop processors generally incorporate a "shallow tank" design, to minimize manufacturing costs, and accordingly, generally require recirculation and replenishment systems, because of the limited liquid volume in each tank. For the purpose of this specification, "shallow tank" refers to tanks, which when filled with liquid to operating levels while containing a transport rack, generally contain liquid with a depth of four (4) inches or less and generally having liquid volumes of one (1) gallon or less per tank.

Because of the costs associated with meeting these various operating requirements, and because of the costs of purchasing, installing and maintaining tabletop automatic film processors, many potential customers have been unable to justify the cost of purchasing such tabletop automatic film processors, particularly if their daily film usage is low. Consequently, these potential customers have continued to utilize hand tanks (trays) and manual hand dipping and air-drying in order to obtain dry, fully developed films. While "hand-tank" development produces acceptable films, the use of open chemical tanks or trays in a medical or medical-like environment is undesirable. In addition, there is no convenient way for an operator to tell when the chemicals in use should be replenished or replaced.

We have devised a low-cost, automated film processing system which can economically replace the existing hand-dipping development of films, but which is also later expandable in field, to accommodate additional features, should the owner wish to upgrade the capabilities of the processor.

BRIEF SUMMARY OF THE INVENTION

One of the objects of this invention is to provide a low-cost automated tabletop film processor.

Another object of this invention is to provide a low-cost, automated table-top film processor having an enclosure and internal structures which are designed to accommodate the in-field installation of upgradeable features for the system easily, at any later date.

Another object of this invention is to provide a low-cost, automated, easily-upgradeable-in-field tabletop film processor, which provides for the development of x-ray film at room temperatures, without heated chemistry or a heated dryer.

Another object of this invention is to provide a low-cost, automated, easily-upgradeable-in-field table-top film developer system which does not require heated chemicals nor a heated dryer nor recirculation mechanisms nor automated replenishment systems nor external plumbing for operation, but which is capable of easy in the field upgrading to include one or more of the above features.

Other objects will be apparent to those skilled in the art in light of the following description and accompanying drawings.

In accordance with this invention, a low-cost table-top x-ray film processor capable of being easily-upgradeable in the field at a later date, by incorporating internal component placement at predetermined locations within the processor is provided. In the preferred embodiment a first tank for containing developer solution, a second tank for containing a fixer solution, and a third tank for containing wash water are used. Preferably, each of the tanks is substantially deeper than normally required for film processing. The chemistry employed in the embodiment illustrated is chosen so as to enable the processor to operate for long periods at room temperature. A dryer section incorporating air blowers but with no air-heating or film-heating elements also is provided. A transport rack drive system for advancing film through the first, second and third tanks and thru the dryer section is operated by a variable speed motor operably connected to the transport rack drive system. Motor speed adjustments adjust the time required to process film through the tanks and dryer, and provides compensation for degradation of the chemical composition of the fixer and developer solutions, variations in ambient room temperature, and; differing density requirements for film processing.

DETAILED DESCRIPTION OF THE PREFERRED EMBODIMENT

The following detailed description illustrates the invention by way of example and not by way of limitation. This description will clearly enable one skilled in the art to make and use the invention, and describes several embodiments, adaptations, variations, alternatives and uses of the invention, including what is presently believed to be the best way of carrying out the invention.

Figure 1:
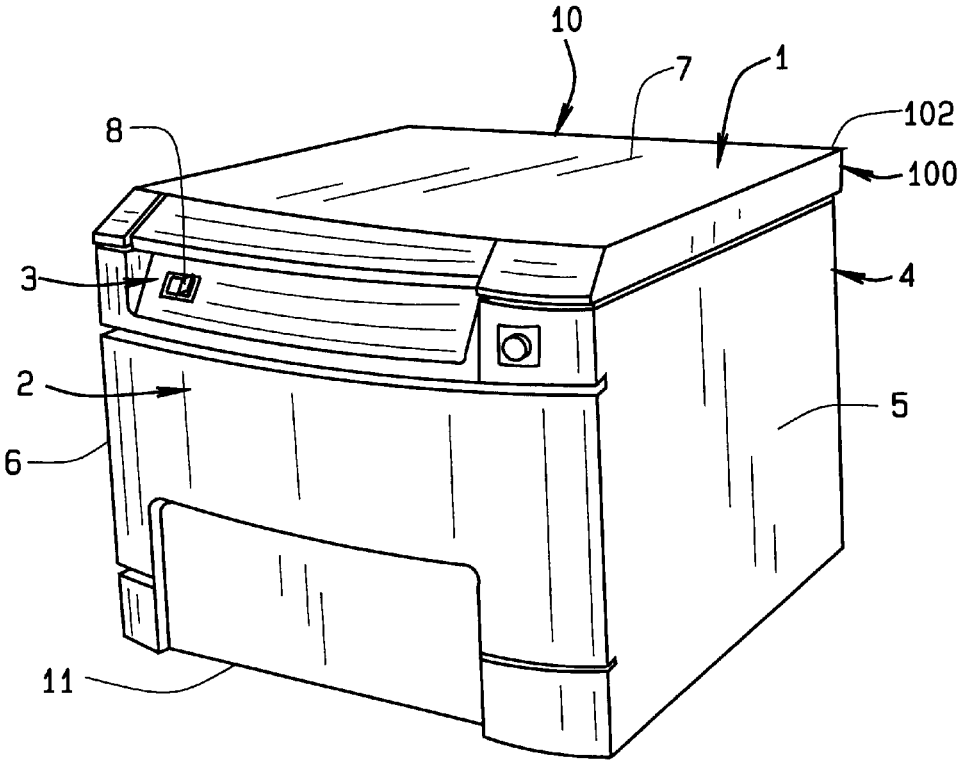
FIG. 1 is a view in perspective of one illustrative embodiment of processor of the present invention.
Figure 2:
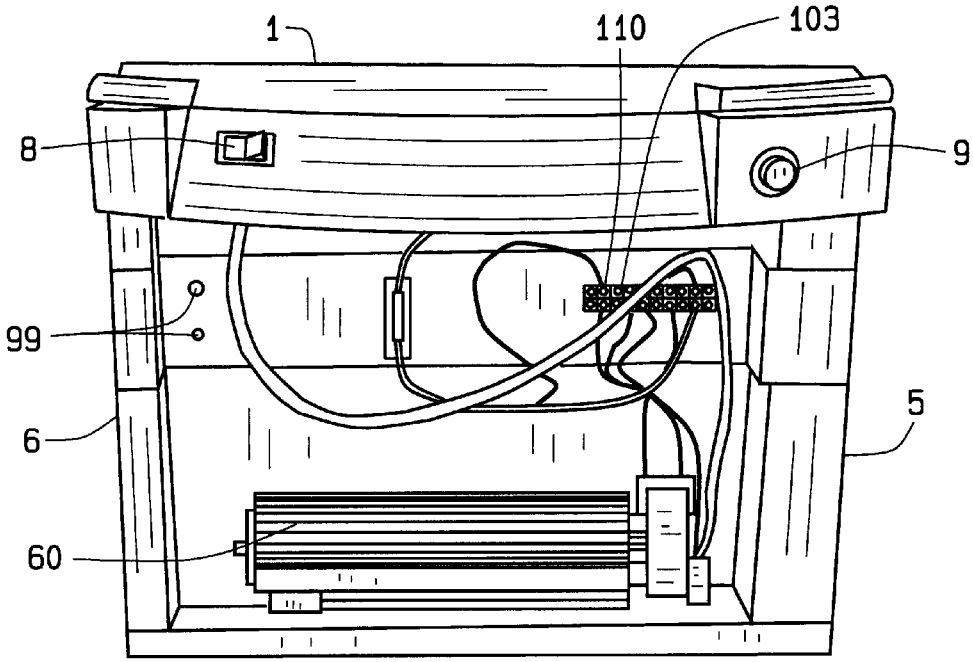
FIG. 2 is a front interior view, with a lower front panel removed, showing the dryer blower, terminal block and selected connections for the processor of the present invention.

Referring now to FIG. 1, reference number 100 refers to one illustrative embodiment of film processor of the present invention. The film processor 100 has an enclosure 102, which, in the embodiment illustrated, includes a top cover 1, a lower-front panel 2, and upper front panel 3, a back panel 4, side panels 5 and 6, and a film feed cover 7. Those skilled in the art will recognize that the back 4 and front panels 2 and 3 also are sidewalls for the purposes of this specification. Other embodiments of our invention may employ alternative arrangements for the enclosure 102 design. The upper front panel 3 of the processor 100 has a main power switch 8 and a variable speed control dial 9 mounted to it. The power switch 8 is interposed in a power cord 115 so as to be operatively connected between one side of the electrical line carried by the cord 115 and a terminal board 103. The power switch 8 selectively applies electrical power to the terminal board 103 (FIG. 2). The top cover 1 has a film entrance receptacle 10 formed near the rear of the top cover 1, under the film feed cover 7, and developed film exits the processor 100, in a downward direction, immediately behind the bottom of lower front panel 2, at a film exit 11.

Figure 8:
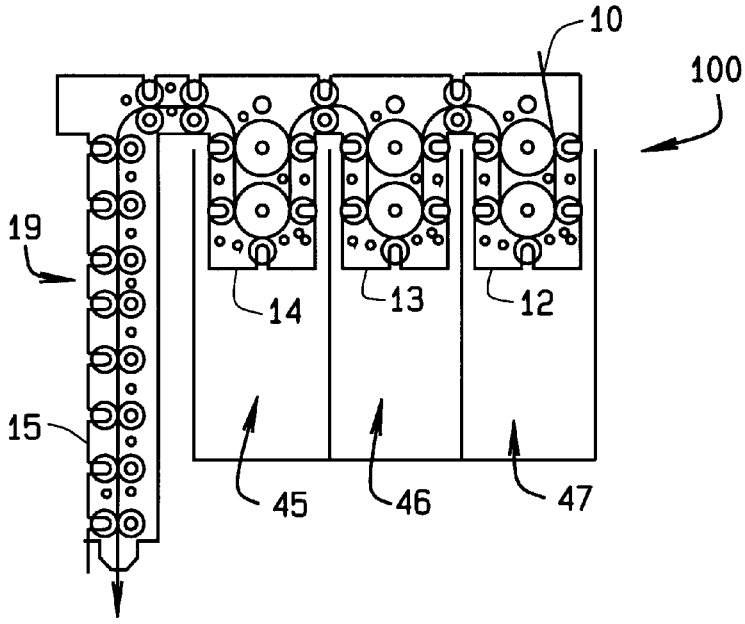
FIG. 8 is a diagrammatic view showing the film path of the system through the developer, fixer, wash and dryer sections of the device.

Referring now to FIG. 8, a diagrammatic view of the operation of the processor 100 shown in FIG. 1 is illustrated. As indicated, film is inserted along an entrance 10 and proceeds through a short developer transport rack 12, which is immersed in a deep developer tank 47, then through a short fixer transport rack 13, which is immersed in a deep fixer tank 46, then through a short rinse water wash transport rack 14, which is immersed in a deep wash tank 45. Upon exiting the short rinse wash transport rack 14, the film is transported by a long dryer transport rack 15 through a dryer plenum 19, after which film then exists the processor 100 at film exit 11. While the general description of film movement just described is conventional, the use of deep tanks with short racks is an important feature of the invention, as later described in detail. It is here noted that the term deep tank refers to tanks having a fluid depth of at least seven (7) inches with of fluid volume capacity of at least two gallons.

Figure 7:
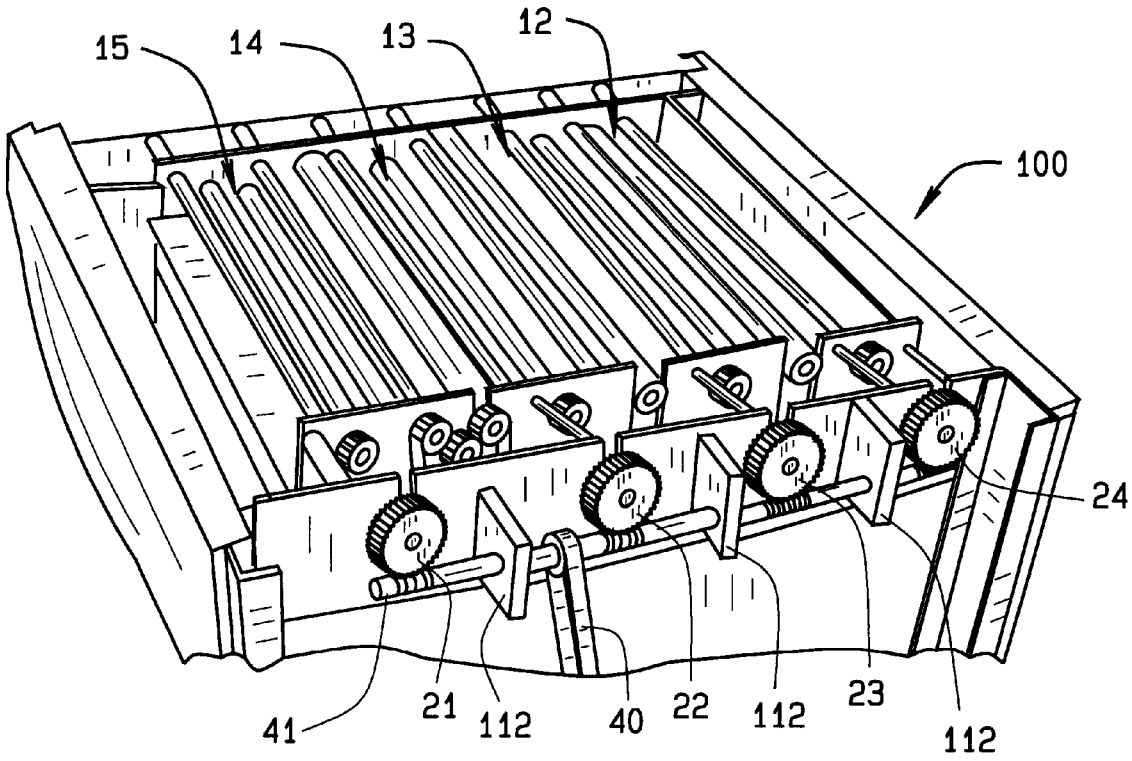
FIG. 7 is a top perspective interior view, partly broken away, with the top cover removed, showing the developer, fixer, wash and dryer transport racks of the present invention.

In the embodiment of the present invention, a motor 30 (shown in FIG. 4) has an output side connected to a belt 40. The belt 40 powers a worm gear drive rod 41. The rod 41 is mounted for rotation along support blocks 112. The rod 41 in turn powers four drive helical worm gears 21, 22, 23 and 24 of each of four transport racks 12, 13, 14 and 15 respectively, as is best shown in FIGS. 3 and 7.

Figure 4:
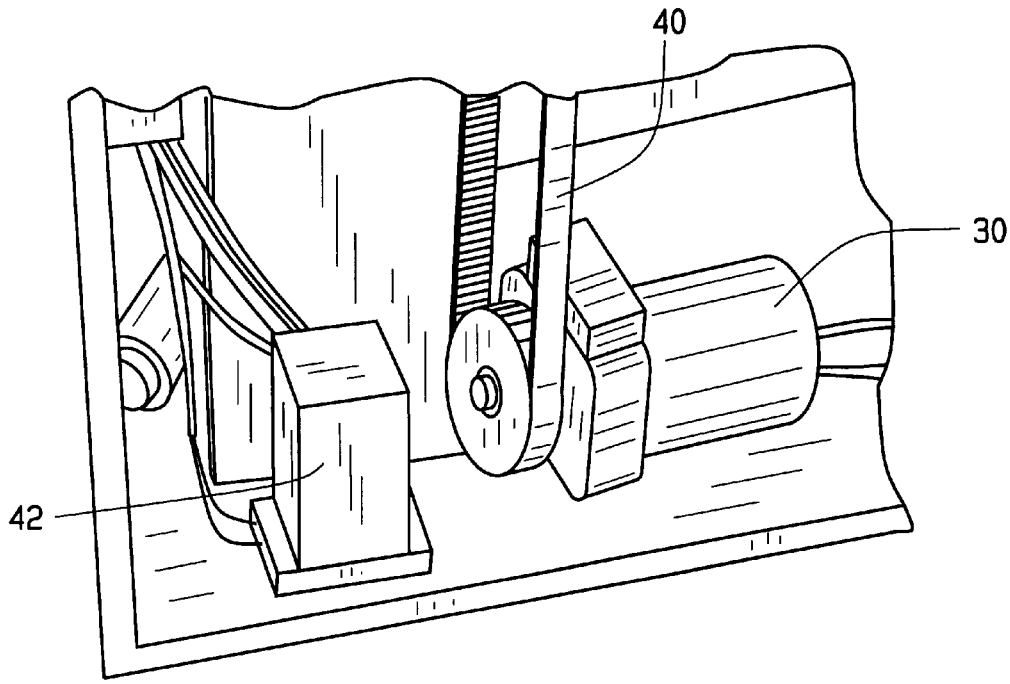
FIG. 4 is an enlarged drive-side interior view, partly broken away, illustrating the variable-speed motor and motor controller.
Figure 5:
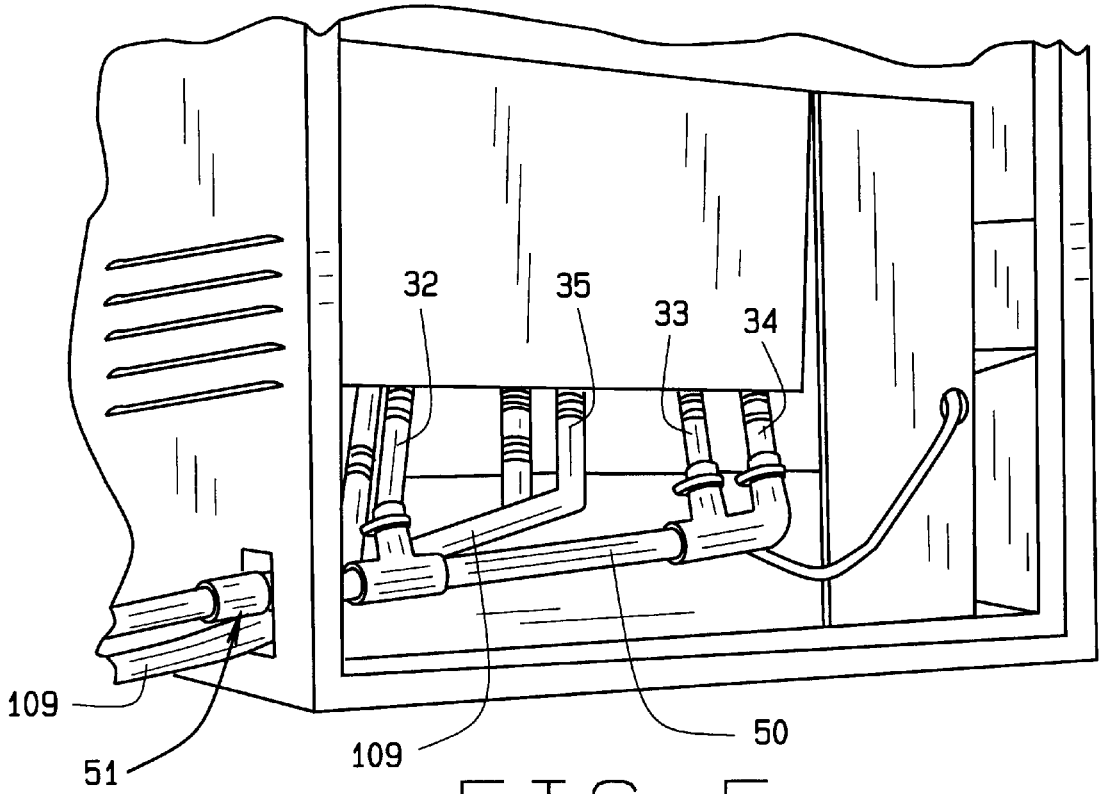
FIG. 5 is a non-drive-side interior view, partly broken away, illustrating the drain system for emptying the developer, fixer and rinse-water wash tanks of the present invention.
Figure 6:
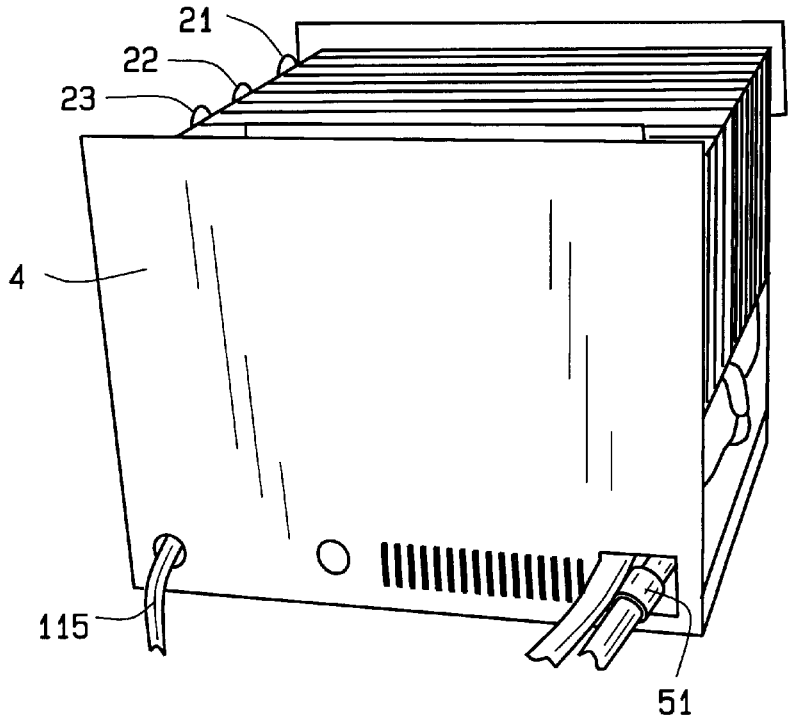
FIG. 6 is a rear elevation view, showing the location of the input power cord for the processor, and a removable conventional drain hose connection, operable with an internal drain system of the present invention.

Referring now to FIG. 4, a motor speed control 42 is operably connected to the variable processing speed control dial 9 on the upper front panel 3 of the processor shown in FIG. 1, and to the motor 30 through the terminal board 103. Referring to FIG. 5, a drain manifold 50 is operably connected to a developer tank drain connection 32, and the water tank drain connections 33 and 34. Each of the connections 32, 33 and 34 have manual stand-pipe drain tubes associated with them, which are opened to drain their respective tanks for purposes later described. The drain manifold has an output side 51. The output side 51 may be connected to a conventional hose, for example, when draining of the tanks is desired. No hose or other plumbing connections are required for operation of the processor shown in FIG. 1, but chemical fixer in fixer tank 46 must normally be drained via a manual standpipe drain tube, to a dedicated hose 109 from fixer tank connection 35 to a segregated container outside of the processor, for silver recovery and environmentally-approved disposal.

Figure 3:
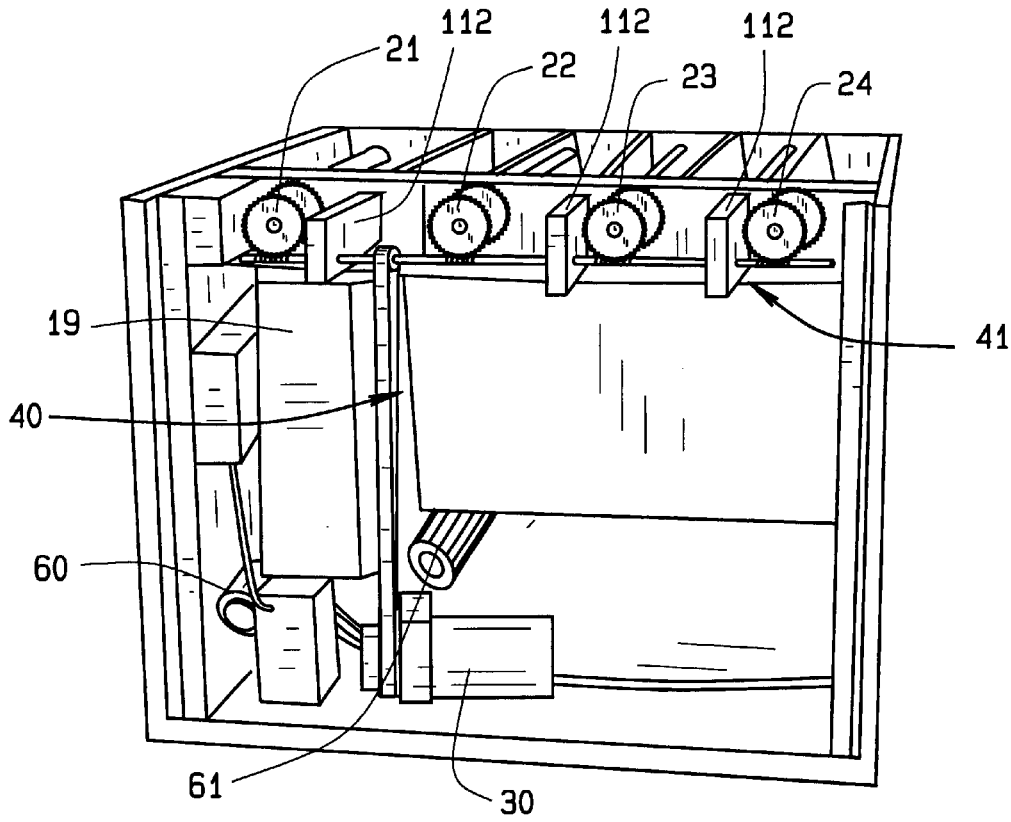
FIG. 3 is a drive-side interior view, with the drive-side cover panel removed, illustrating the side-wall of the solution tanks, the transport rack drive gears, the variable speed motor and the dryer blowers utilized in conjunction with the processor of the present invention.

The processor 100, as shown in FIG. 3, also includes a pair of dryer blowers 60 and 61, which are positioned to direct air through the drying plenum 19 of the processor. Because the present invention operates at room temperature, thereby not requiring heating elements, the unit does not use electrical power when film is not being transported through the travel path. Additionally, there is no wait time for the developer solution to reach operating temperature after the processor has been turned on. Further, the use of short racks in deep tanks containing unheated chemistries eliminates the need for recirculation and replenishment systems, because: (a) the use and storage of chemistry at room temperature greatly minimizes evaporation, oxidation and degradation of the chemistry, thereby greatly extending its productive life, and (b) deep tanks hold 2 to 3 times more chemistry per tank than shallow tank processors, thereby allowing extended life, i.e., 2 to 3 weeks of operation without needing replenishment, and; (c) the short rack system allows contaminants and spent emulsion to sink to the bottom of their respective deep tanks, away from the racks and rollers. Because of the settling, operation of the racks and rollers provides circulation of clean chemistry and clean rinse water during the developing process. Finally, none of the complex electrical or electronic circuitry needed to monitor and control heating elements is required, since no heaters are utilized. Without the use of heaters, the development process takes a slightly longer time and, therefore, throughput is reduced. However, the benefits of a less expensive, more efficient processor clearly outweigh the slightly increased development time for low volume applications.

EXAMPLE

As indicated, the processor 100 has no chemical heating elements, no microprocessor, no feed switch, no lamps, no floaters, no buzzer, no fixer/developer tank recirculation, no replenishment, no water solenoid and no dryer heat. The only electrical components in this machine are the two dryer plenum blowers and the variable speed drive motor. The drive motor and two dryer plenum blowers are connected to a terminal strip that is energized by a conventional main power switch via a 15-amp fuse block, although actual power draw, with full tanks and while developing film, is less than 4 amps, thereby permitting the processor 100 to be utilized when only 10 amp power sources or less are available. Moreover, the processor 100 is only run while developing film. There is standby mode.

The processor 100 of the present invention was placed in a user location. The developer and fixer tanks were filled with pre-mixed developer and fixer into the respective first and second tanks 47 and 46. The third tank 45 was filled with plain tap water. The variable processing speed control dial 9 was set at the fastest setting, which generates a film throughput time of 3 minutes and 43 seconds. This processing speed was kept constant over the entire duration of the test.

Diagnostic Imagining, Image Plus Green 14X17 x-ray film was used throughout the example. This film was exposed using a General Electric Mobile 90-II x-ray unit. The x-ray unit was set at 15 MA adjusted for 50 k-V peak, with a 4/10 second exposure time. The x-ray tube head was adjusted to 25 inches over the table using the flexible steel scale on the side of the tube head. The x-ray subject was a circuit board.

Each working day during the test period, three films were exposed and developed in the processor 100. Each film was dated and numbered for that date. After the films were processed, the developer temperature was measured using a thermometer, and recorded on the film.

Figure 9:
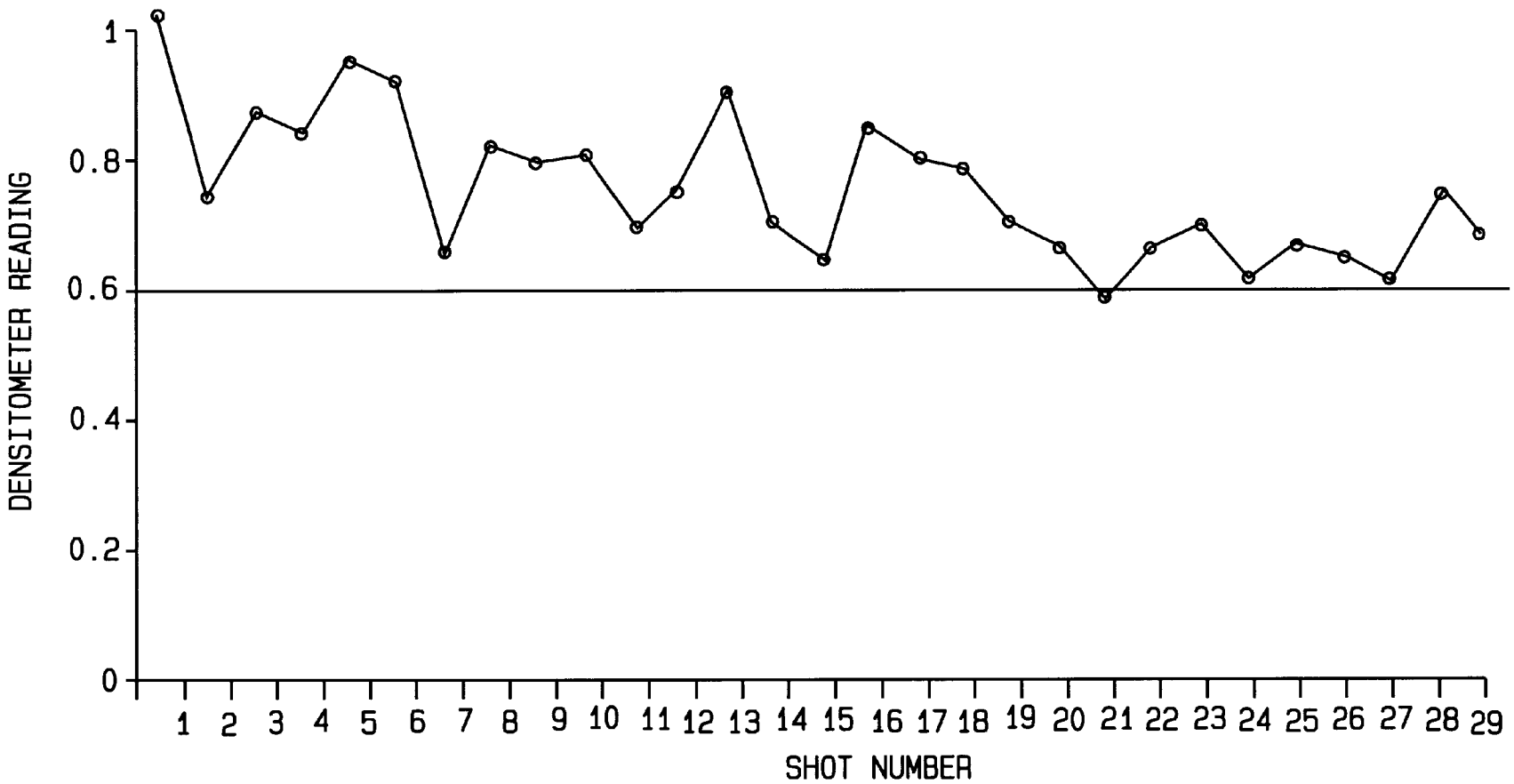
FIG. 9 is a chart illustrating operation of the processor of the present invention with room temperature chemistry associated with the developer and fixer tanks.

A Sakura PDA-85 densitometer was used to measure film density (contrast) on each piece of film exposed during the test. A total of 29 films were processed for the example. Throughout the duration of example, the films developed clearly and legibly. Although there was no dryer heat, film was found to be dry when exiting the processor. The data recorded during testing is shown in the table below and in the graph of FIG. 9. Since there is no control over developer temperature, density can be increased, if necessary, by increasing the film processing time. Of course, density can also be improved by adding fresh chemical and changing wash water.

Although the films developed clearly and with good contrast throughout the duration of the test, density (contrast) readings gradually degraded over time as the chemicals weakened and the wash water became polluted. It was noted that density rebounded after the machine was allowed to sit over night or over a weekend, but declined as each film was processed. This effect probably resulted when weak chemical settled to the bottom of the tank during long periods of inactivity.

FIG. 9 Data

| Shot No. | Day | Developer Temp (Deg F.) | Densitometer | Comments |
|---|---|---|---|---|
| 1 | 1 | 77 | 1.02 | Processing speed set |
| 2 | 1 | 77 | 0.74 | at 3 minutes, 43 seconds |
| 3 | 1 | 77 | 0.87 | |
| 4 | 5 | 79 | 0.84 | |

-continued

FIG. 9 Data

| Shot No. | Day | Developer Temp (Deg F.) | Densitometer | Comments |
|---|---|---|---|---|
| 5 | 5 | 79 | 0.95 | |
| 6 | 5 | 79 | 0.92 | |
| 7 | 6 | 81 | 0.66 | |
| 8 | 6 | 81 | 0.82 | |
| 9 | 6 | 81 | 0.79 | |
| 10 | 7 | 80 | 0.80 | |
| 11 | 7 | 80 | 0.69 | |
| 12 | 7 | 80 | 0.75 | |
| 13 | 11 | 81 | 0.90 | |
| 14 | 11 | 81 | 0.70 | |
| 15 | 11 | 81 | 0.64 | |
| 16 | 12 | 79 | 0.84 | Morning |
| 17 | 12 | 79 | 0.80 | |
| 18 | 12 | 79 | 0.78 | |
| 19 | 12 | 81 | 0.70 | Afternoon |
| 20 | 12 | 81 | 0.66 | |
| 21 | 12 | 81 | 0.58 | |
| 22 | 13 | 81 | 0.66 | |
| 23 | 13 | 81 | 0.69 | |
| 24 | 13 | 81 | 0.61 | |
| 25 | 15 | 80 | 0.66 | 0.3 gallons of fixer added |
| 26 | 15 | 80 | 0.64 | |
| 27 | 15 | 80 | 0.61 | |
| 28 | 20 | 78 | 0.74 | #1 was thrown out- |
| 29 | 20 | 78 | 0.68 | two films stuck together |

While the specific embodiments have been illustrated and described, numerous modifications come to mind without significantly departing from the spirit of the invention, and the scope of protection is only limited by the scope of the accompanying claims. As indicated, the enclosure 120 design may vary in other embodiments of the invention. An important feature of the enclosure 120 and processes it contains is that the processor 100 is easily upgradeable in the field, after installation and use. Thus, if a user requires faster film throughput, a heater can be easily installed in the developer tank to heat the developer chemistry, and/or a pair of heaters can be easily-installed in the dryer plenum to dry film quicker, and/or deeper racks may be used, to provide more time in developer. Likewise, the unit may be upgraded with virtually all other features of more conventional fully automatic processor units. To accomplish these modifications, the enclosure 102 and/or the terminal board 103, for example, may have predrilled openings from in them as shown, for example by the reference number 99 in FIG. 3, where electrical connections for the additional heaters may be made. Further, the terminal board 103 may be pre wired, as shown at 10, to ease such installation. In addition, the racks are easily removed and replaced without requiring special knowledge or ability. These variations are merely illustrative.

Having thus described the invention, what is claimed and desired to be secured by letters patent is:

1. A low cost x-ray film processor capable of upgrading, comprising:

a first tank for containing a developer solution;

a second tank for containing a fixer solution;

a third tank for containing a cleaning solution, the developer and fixer solutions having a chemical composition capable of operation at room temperature;

a plenum chamber;

a plurality of rollers configured for advancing film through only an upper portion of each of said first, second, and third tanks and through said plenum, said plurality of rollers further configured to circulate solution within each of said first, second, and third tanks;

a variable speed motor operably connected to drive said plurality of rollers, a speed of said motor being manually adjustable to compensate for at least the chemical decomposition of the fixer and developer solutions over time.

2. The processor of claim 1 wherein said variable speed drive is manually adjustable to compensate for ambient room temperatures and for differing density requirements of the x-ray film being processed.

3. The processor of claim 1 wherein the film processor has an enclosure, the enclosure including a plurality of predrilled holes for accepting components at a later time for upgrading operation of the processor, said components including one or more from the set of chemical heaters, heated dryers, re-circulation mechanisms, automated chemical replenishment systems, and external chemical plumbing.

4. The processor of claim 3 further including at least one blower mounted in said enclosure and adapted to direct unheated air through said plenum.

5. The processor of claim 1 further including a drain system connected to said first, second, and third tanks, said drain system operable to permit selective draining of said tanks.

6. The processor of claim 5 further including an enclosure, the enclosure having a top wall, back wall, front wall, and two side walls, at least one of said walls being removable to provide access to the tanks for manual refilling thereof, and at least two of said walls being removable to provide for in-field installation of one or more upgrade components, said upgrade components including one or more from the set of chemical heaters, heated dryers, re-circulation mechanisms, and automated chemical replenishment systems.

7. The processor of claim 1 wherein each of said first, second, and third tanks has a depth sufficient to enable contaminants to settle to a lower portion thereof, below said plurality of rollers, while permitting fluid in said upper portion of said tanks to be circulated by operation of advancing the film through said tanks.

8. The processor of claim 6 wherein said enclosure has a plurality of predrilled openings in it, said predrilled openings enabling the mounting of said upgrade components within said enclosure for field upgrading of the processor.

9. The processor of claim 1 wherein said first, second, and third tanks are substantially deeper than said plurality of rollers, thereby enabling contaminants in each of said tanks to settle under gravity while permitting said plurality of rollers to circulate said respective solutions in each of said tanks to develop film advancing through those tanks.

10. An x-ray film developing system, comprising:

a developer tank, said developer tank configured to retain an ambient temperature developer solution;

a developer tank transport rack disposed in an upper portion of said developer tank, said developer tank transport rack configured to transport film through said upper portion of said developer tank and to circulate said developer solution in said upper portion of said developer tank;

a fixer tank disposed adjacent to said developer tank, said fixer tank configured to retain an ambient temperature fixer solution;

a fixer tank transport rack disposed in an upper portion of said fixer tank, said fixer tank transport rack configured to receive film from said developer transport rack to transport film through said upper portion of said fixer tank and to circulate said fixer solution in said upper portion of said fixer tank;

a cleaning tank disposed adjacent to said fixer tank, said cleaning tank configured to retain an ambient temperature cleaning solution;

a cleaning tank transport rack disposed in an upper portion of said cleaning tank, said cleaning tank transport rack configured to receive film from said fixer transport rack to transport film through said upper portion of said cleaning tank and to circulate said cleaning solution in said upper portion of said cleaning tank;

a vertically elongated plenum chamber disposed adjacent said cleaning tank;

a plenum chamber transport rack disposed in said plenum chamber, said plenum chamber transport rack configured to receive film from said cleaning tank transport rack and to transport film vertically through said plenum chamber;

a variable speed motor operably connected to drive each of said developer tank transport rack, said fixer transport rack, said cleaning tank transport rack, and said plenum chamber transport rack, a speed of said motor being manually adjustable; and wherein each of said developer tank, said fixer tank, and said cleaning tank have a vertical dimensions sufficient to permit settling of contaminants below a film transport pathway through said respective transport racks.

* * * * *